US011566509B2

(12) United States Patent
Jeffryes

(10) Patent No.: US 11,566,509 B2
(45) Date of Patent: Jan. 31, 2023

(54) METHODS OF DRILLING USING MIXED PROPORTIONAL INTEGRAL DERIVATIVE CONTROL

(71) Applicant: Schlumberger Technology Corporation, Sugar Land, TX (US)

(72) Inventor: Benjamin Peter Jeffryes, Histon (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 68 days.

(21) Appl. No.: 17/201,449

(22) Filed: Mar. 15, 2021

(65) Prior Publication Data

US 2021/0301640 A1 Sep. 30, 2021

Related U.S. Application Data

(60) Provisional application No. 62/993,869, filed on Mar. 24, 2020.

(51) Int. Cl.

| | |
|---|---|
| ***E21B 44/06*** | (2006.01) |
| ***E21B 44/02*** | (2006.01) |
| ***E21B 21/08*** | (2006.01) |
| ***E21B 45/00*** | (2006.01) |

(52) U.S. Cl.

CPC ..... *E21B 44/02* (2013.01); *E21B 21/08* (2013.01); *E21B 44/06* (2013.01); *E21B 45/00* (2013.01)

(58) Field of Classification Search

CPC ..... E21B 44/06

See application file for complete search history.

(56) References Cited

U.S. PATENT DOCUMENTS

| | | | | |
|---|---|---|---|---|
| 3,581,830 | A | 6/1971 | Stoner | |
| 7,819,183 | B2 | 10/2010 | Borgstadt | |
| 2018/0128093 | A1* | 5/2018 | Jeffryes | E21B 45/00 |

OTHER PUBLICATIONS

Carlesen, L.A. et al., "Utilizing Instrumented Stand Pipe for Monitoring Drilling Fluid Dynamics for Improving Automated Drilling Operations", Proceedings of the 2012 IFAC Workshop on Automatic Control in Offshore Oil and Gas Production, Trondheim, Norway, May 31-Jun. 1, 2012, 6 pages.

* cited by examiner

*Primary Examiner* — Giovanna Wright

(57) ABSTRACT

A proportional integral derivative (PID) controller implements control over a drilling system based on an integral term and a proportional term. The integral term is the integral of an operating drilling fluid pressure compared to a target drilling fluid pressure. The proportional term is the difference between an operating weight on bit and a target weight on bit. The sum of the proportional term and the integral term is multiplied by a controller parameter to determine a surface rate of penetration. A drill pipe lowering rate may be changed based on the determined surface rate of penetration, and the process may repeat in an iterative cycle until the integral term is reduced to an acceptable degree.

20 Claims, 4 Drawing Sheets

METHODS OF DRILLING USING MIXED PROPORTIONAL INTEGRAL DERIVATIVE CONTROL

CROSS-REFERENCE TO RELATED APPLICATIONS

This application claims the benefit of, and priority to, U.S. Patent Application No. 62/993,869, filed Mar. 24, 2020 and titled "Mixed Proportional Integral Derivative Drilling Control", which is expressly incorporated herein by this reference.

BACKGROUND

During downhole drilling, the drill bit may encounter different drilling conditions. For instance, the formation being drilled may change or the formation fluid pressure may change. These different conditions may affect the drilling procedure and impact drilling parameters such as the rate of penetration, drilling fluid pressure, weight on bit, and torque. In response to the changing drilling conditions, an operator may change one or more of the drilling parameters. For example, the operator may change the weight on bit or the rotational speed of the drill bit. The operator may also change the rate at which drill pipe is lowered into the wellbore. In some embodiments, a proportional integral derivative (PID) controller may control the rate at which the drill pipe is lowered into the wellbore.

SUMMARY

In some embodiments, a method for drilling includes determining a weight difference between an operating weight on bit and a target weight on bit. The method includes determining a pressure difference between an operating drilling fluid pressure and a target drilling fluid pressure and determining an integrated pressure over time based on the pressure difference. A surface rate of penetration is determined based on the integrated pressure and the weight difference, and, based on the surface rate of penetration, the drill pipe lowering rate is changed.

In some embodiments, a method for drilling includes determining a pressure difference between an operating drilling fluid pressure and a target drilling fluid pressure. The pressure difference is integrated over time for an integrated pressure. The method further includes determining a weight difference between an operating weight on bit and a target weight on bit and multiplying the weight difference by a proportional term for a weight proportional term. The integrated pressure, the pressure difference, and the weight proportional term are added for a proportional-integral sum. A surface rate of penetration is determined based on the proportional-integral sum. The drill pipe lowering rate is changed based on the surface rate of penetration.

In some embodiments, a method for drilling includes obtaining an operating drilling fluid pressure and determining a pressure difference based on the operating drilling fluid pressure and a target drilling fluid pressure. An integrated pressure is determined based on the pressure difference. An operating weight on bit is obtained and a weight difference is determined based on the operating weight on bit and a target weight on bit. A drill pipe lowering rate is changed based on at least one of the weight difference or the integrated pressure.

This summary is provided to introduce a selection of concepts that are further described in the detailed description. This summary is not intended to identify key or essential features of the claimed subject matter, nor is it intended to be used as an aid in limiting the scope of the claimed subject matter. Additional features and aspects of embodiments of the disclosure will be set forth herein, and in part will be obvious from the description, or may be learned by the practice of such embodiments.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which.

DETAILED DESCRIPTION

Embodiments of the present disclosure relate to systems and methods for the control of a downhole drilling system. In some embodiments, aspects of a drilling system may be automatically controlled using a proportional integral derivative (PID) controller. PID controllers analyze state data of a system, and analyze past (e.g., using an integral term), present (e.g., using a proportional term), and projected future (e.g., using a derivative term) values of the state data to control the system. PID controllers of the present disclosure are responsive to both drilling fluid pressure measurements and weight-on-bit (WOB) measurements. Because drilling fluid pressure measurements lag WOB measurements to indicate a change to the rate of penetration (ROP), using drilling fluid pressure for the integral term and WOB for the proportional term may allow the system to be more responsive or to have improved stability.

Figure 1:
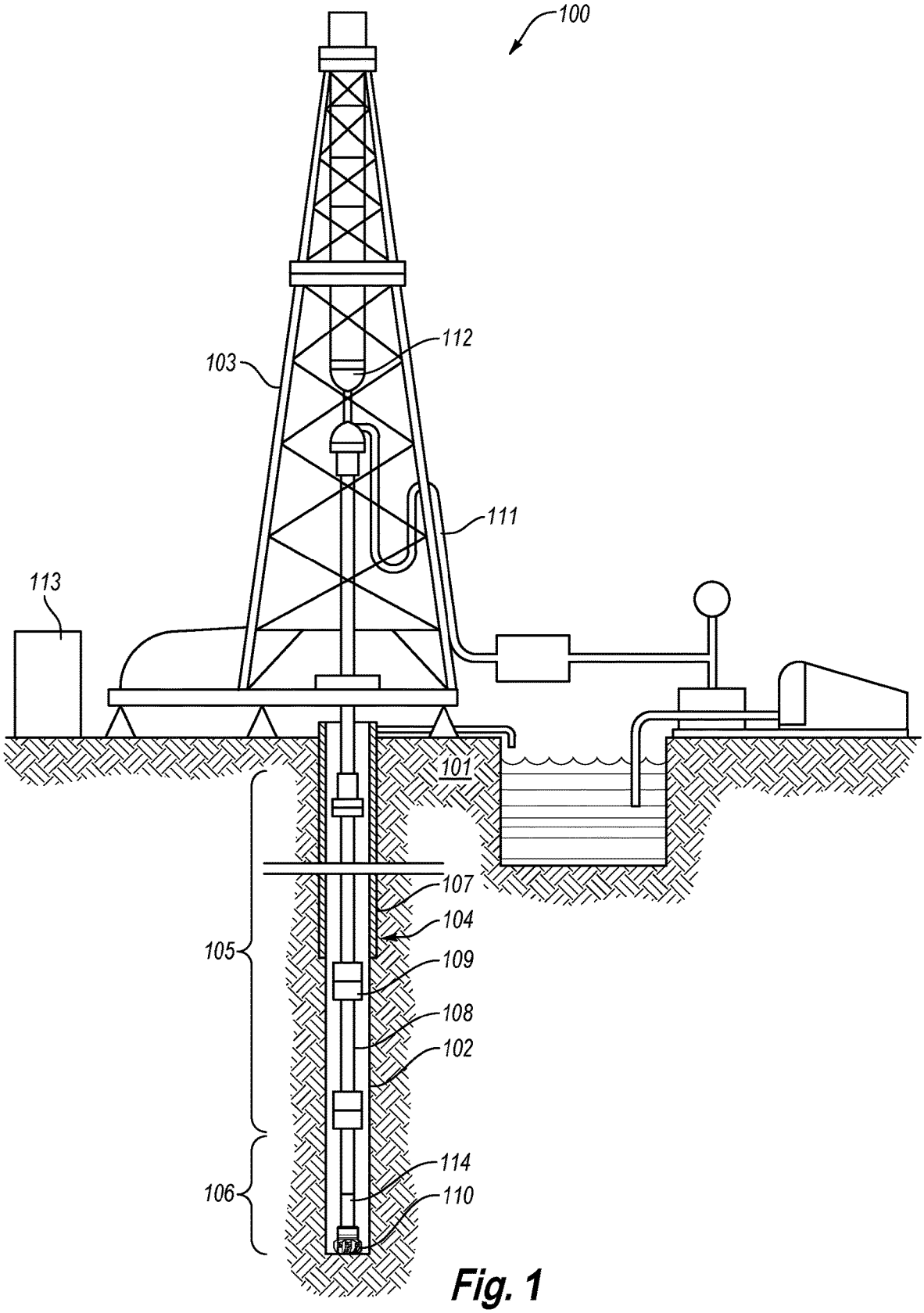
FIG. 1 is schematic illustration of a drilling system, according to at least one embodiment of the present disclosure.

FIG. 1 shows one example of a drilling system 100 for drilling an earth formation 101 to form a wellbore 102. The drilling system 100 includes a drill rig 103 used to turn a drilling tool assembly 104 which extends downward into the wellbore 102. The drilling tool assembly 104 may include a drill string 105, a bottomhole assembly (BHA) 106, and a bit 110, attached to the downhole end of drill string 105.

The drill string 105 may include several joints of drill pipe 108 connected end-to-end through tool joints 109. The drill string 105 transmits drilling fluid through a central bore and transmits rotational power from the drill rig 103 to the BHA 106. In some embodiments, the drill string 105 may further include additional components such as subs, pup joints, etc. The drill pipe 108 provides a hydraulic passage through which drilling fluid is pumped from the surface. The drilling fluid discharges through selected-size nozzles, jets, or other orifices in the bit 110 for the purposes of cooling the bit 110 and cutting structures thereon, and for lifting cuttings out of the wellbore 102 as it is being drilled.

The BHA 106 may include the bit 110 or other components. An example BHA 106 may include additional or other components (e.g., coupled between to the drill string 105 and the bit 110). Examples of additional BHA components include drill collars, stabilizers, measurement-while-drilling (MWD) tools, logging-while-drilling (LWD) tools, downhole motors, underreamers, section mills, hydraulic disconnects, jars, reamers, vibration or dampening tools, other components, or combinations of the foregoing. The BHA 106 may further include a rotary steerable system (RSS). The RSS may include directional drilling tools that change a direction of the bit 110, and thereby the trajectory of the wellbore. Optionally, at least a portion of the RSS maintains a geostationary position relative to an absolute reference frame, such as gravity, magnetic north, or true north. Using measurements obtained with the geostationary position, the RSS may locate the bit 110, change the course of the bit 110, and direct the directional drilling tools on a projected trajectory.

In some embodiments, an optional downhole motor 114 in the BHA 106 may generate power for downhole systems and/or provide rotational energy for downhole components (e.g., rotate the bit 110). The downhole motor may be any type of downhole motor, including a positive displacement pump (such as a progressive cavity motor) or a turbine (also known as a turbodrill). The downhole motor may be powered by the drilling fluid. In other words, the drilling fluid pumped downhole from the surface may provide the energy to rotate a rotor in the downhole motor. The downhole motor may operate with an optimal pressure differential or pressure differential range. The optimal pressure differential may be the pressure differential at which the motor may not stall, burn out, overspin, or otherwise be damaged.

In general, the drilling system 100 may include other drilling components and accessories, such as special valves (e.g., kelly cocks, blowout preventers, and safety valves). Additional components included in the drilling system 100 may be considered a part of the drilling tool assembly 104, the drill string 105, or a part of the BHA 106 depending on their locations in the drilling system 100.

The bit 110 in the BHA 106 may be any type of bit suitable for degrading downhole materials. For instance, the bit 110 may be a drill bit suitable for drilling the earth formation 101. Example types of drill bits used for drilling earth formations are fixed cutter or drag bits, roller cone bits, and coring bits. In other embodiments, the bit 110 may be a mill used for removing metal, composite, elastomer, other materials downhole, or combinations thereof. For instance, the bit 110 may be used with a whipstock to mill into casing 107 lining the wellbore 102. The bit 110 may also be a junk mill used to mill away tools, plugs, cement, other materials within the wellbore 102, or combinations thereof. Swarf or other cuttings formed by use of a mill may be lifted to surface, or may be allowed to fall downhole.

A plurality of measurements may be taken at the drill rig 103 in order to measure various different parameters that occur at, or are discernible from, a surface location. For example, the drilling fluid pressure may be measured at a standpipe 111. A traveling block 112 may lower the drill string 105 into the wellbore 102 with a drill pipe lowering rate. The surface or downhole WOB may be determined or inferred based on the weight supported by the traveling block 112. However, for the purposes of this disclosure, WOB may be either the WOB determined based on measurements taken at the surface (e.g., a surface WOB), or the WOB may be the WOB determined based on measurements taken downhole (e.g., a downhole WOB). In some embodiments, the downhole WOB may be more representative of the actual weight supported by the bit. However, the downhole WOB measurements may take time to reach the surface, and therefore the surface WOB may be used in drilling control systems. In some embodiments, the surface WOB may be compared to the downhole WOB measured at the same time. The surface WOB may be then modified based on the downhole WOB. A drilling system controller 113 may be located at the surface. The drilling system controller 113 may include processors and memory which receive the measurements of WOB and drilling fluid pressure. The drilling system controller 113 may further include a PID controller, which may control drilling processes. For example, the PID controller may control the movement of the traveling block 112, which may control the WOB and, indirectly, the drilling fluid pressure.

The bit 110 drills with a ROP, which may be related to the drill pipe lowering rate; however, there may not be a directly proportional relationship, and increasing the drill pipe lowering rate may not produce the same increase to the ROP. Increasing the drill pipe lowering rate may, however, also increase the WOB (and decreasing the rate may correspondingly decrease the WOB). Increasing the WOB may also increase the drilling fluid pressure. Thus, both the WOB and the drilling fluid pressure may be controlled to at least some degree by changing the drill pipe lowering rate of the traveling block 112.

A PID controller for a drilling system may analyze the hydraulic pressure of the drilling fluid as measured from the standpipe at the surface. The PID controller may generally follow Equation. 1-1:

$$v = -a\left[\frac{1}{\tau}\int(F - F_0) + (F - F_0) + \delta\frac{d(F - F_0)}{dt}\right] \quad \text{EQ. 1-1}$$

where v is the surface ROP (i.e. the rate at which a traveling block on the derrick is lowered or the rate the drill pipe is lowered into the wellbore), a is a controller parameter, $\tau$ is an integral parameter, $\delta$ is a derivative parameter, and F is state data, such as WOB, drilling fluid pressure, or torque. As discussed herein, the surface rate of penetration v may affect the drilling parameters. If the surface rate of penetration increases, then the WOB increases. If the surface rate of penetration decreases, then the WOB decreases. The WOB, torque, and drilling fluid pressure have an interrelated relationship. For example, if the WOB is increased, the torque and/or the drilling fluid pressure can also increase. Therefore, any change in v may be reflected by a change to the drilling fluid pressure, WOB, or torque on the bit. The downhole tools optionally include sensors or tools to measure these downhole parameters.

In some embodiments, the PID controller of Equation 1-1 may include a low-pass filter. For example, the results of the right-hand side of Equation 1 may be passed through a low-pass filter before being used to change the surface ROP v. However, for the purposes of the present disclosure, and to provide a clear illustration of the principles of the present disclosure, the PID controllers of the present disclosure may not be described as including a low-pass filter. However, this should not be considered to limit the present disclosure, and each embodiment described herein may include a low-pass filter on the output of the PID controllers prior to changing the surface ROP (v).

In some embodiments, the overall output of the PID controller may be subjected to an additional scaling that compensates for changes in rock strength. In some embodiments, the scaling may use historic values of the actual surface ROP. For example, if the output of Equation 1-1 is designated $v_0$, then the v used to control the travelling block may be of the form shown in Equation 1-2:

$$v=(v_{offset}+L(v))v_0 \quad \text{EQ. 1-2}$$

where $v_{offset}$ is a constant and L is a low-pass filter. Thus, as may be seen, the entirety of the PID controller of Equation 1-1 may have a low-pass filter applied to it. In some embodiments, a different low-pass filter may be applied to each individual element of Equation 1-1. Thus, the integral term may have an integral low-pass filter applied, the proportional term may have a proportional low-pass filter applied, and the derivative term may have a derivative low-pass filter applied. In this manner, the low-pass filters may be tailored to the input and/or the output of each term of Equation 1-1. This may allow for optimization of the PID controller of Equation 1-1.

The PID controller shown in Equation 1-1 includes three terms: an integral term, a proportional term, and a derivative term. The integral term takes an integral of a difference in state data over time. As shown in Equation 1-1, the integral term is $1/\tau$ multiplied by the integral of $(F-F_0)$. The proportional term may be the present difference in state data. As shown in Equation 1-1, the proportional term is $(F-F_0)$, without any multipliers or other operations performed on it. The derivative term takes a derivative of the difference in state data with respect to time. As shown in Equation 1-1, the derivative term is multiplied by the derivative parameter, $\delta$.

The proportional term (e.g., $(F-F_0)$) may be used as proportional feedback based on a change in the state data F. Thus, if the current state data, F, is different than target state data $F_0$, then the surface rate of penetration v would be changed in proportion to the difference between F and $F_0$. For example, if a measured drilling fluid pressure is less than a target drilling fluid pressure (e.g., an optimal drilling fluid pressure), then v may be increased proportion to the difference between the measured drilling fluid pressure and the target drilling fluid pressure. In some embodiments, the target drilling fluid pressure may be the drilling fluid pressure at which a downhole tool may operate. This may be the drilling fluid pressure that the downhole tool is designed to operate, or in which the downhole tool is most efficient and/or effective. If the downhole tool operates outside of the target drilling fluid pressure, then the downhole tool may be inefficient, stall, and/or become damaged. Furthermore, the proportional term may have a proportional term low-pass filter applied. This may help to filter out some of the noise from the signal used to determine the proportional term. In some embodiments, the proportional term low-pass filter may be applied before any proportional parameter is applied to the proportional term. In some embodiments, the proportional term low-pass filter may be applied to the proportional term after any proportional parameter is applied to the proportional term.

The integral term may be used as feedback based on historical state data. Thus, the integral term may be as simple as a summation of each difference between the measured state data F and the target state data $F_0$ (e.g., optimal operating state data) during since the controller is initiated. For example, if the difference between F and $F_0$ is positive, then the integral term will grow and have a bigger impact on v. Similarly, if the difference between F and $F_0$ is negative, then the integral term will shrink and have a smaller impact on v. The duration of time over which the integral is taken may affect the impact of the integral term on v. A longer duration of time may de-emphasize short-term fluctuations in the state data, while a shorter duration of time may be more responsive to changes in the state data F. Furthermore, the integral term may have an integral term low-pass filter applied. This may help to filter out some of the noise from the signal used to determine the integral term. In some embodiments, the integral term low-pass filter may be applied to the integral term before the integral parameter is applied to the integral term. In some embodiments, the integral term low-pass filter may be applied to the integral term before the integral of the integral term is taken. In some embodiments, the integral term low-pass filter may be applied after the integral parameter has been applied to the integral term.

The derivative term may provide an indication of future state data F based on existing and historical state data over time. This term may help to fine-tune the changes to v. For example, if each measurement of F is increasing, then the derivative term may predict that F will continue to increase, and have a compensating effect on v. In some embodiments, $\delta$ may be zero. In other words, the PID controller may be a PI controller, without utilizing any derivative term. Furthermore, the derivative term may have a derivative term low-pass filter applied. This may help to filter out some of the noise from the signal used to determine the integral term. In some embodiments, the derivative term low-pass filter may be applied to the derivative term before the derivative parameter is applied to the derivative term. In some embodiments, the derivative term low-pass filter may be applied to the derivative term before the derivative is taken. In some embodiments, the derivative term low-pass filter may be applied to the derivative term after the derivative parameter has been applied to the derivative term.

In some embodiments, the integral term may be the controlling term on the PID controller. Thus, if $F=F_0$ during the entirety of the integral period, the integral term is zero, and there will be no change to the state data. In this manner, the PID controller may tend to converge on $F_0$ in the integral term. In some embodiments, the PID controller may iteratively change the surface ROP (e.g., v) to converge on the integral term. In other words, the PID controller may output a non-zero v each time a change to the state data F is made, until $F=F_0$ over the integral period. Thus, the PID controller may iteratively change v to minimize the integral term.

In some embodiments, the state data for each element of Equation 1-1 may be the same state data. For example, the state data may be drilling fluid pressure at the standpipe, and the controller may be a PI controller. Thus, Equation 1-1 may be modified to Equation 2:

$$v=-a[1/\tau\int(P-P_0)+(P-P_0)] \quad \text{EQ. 2}$$

Equation 2 represents a PI controller. In some embodiments, Equation 2 may output a change in v. This may increase or decrease the WOB, and therefore the downhole drilling fluid pressure. In some embodiments, the combination of compliance of the fluid in the drill string and the flow-dependent pressure drop across the bit acts as a low-pass hydraulic filter so the change in the pressure seen above the motor may be delayed compared to the change in WOB that causes the change in pressure. This may cause instabilities in the PI controller.

In some embodiments, an instability in the PI controller include an oscillation between a measured P that is higher than $P_0$ and a measured P that is lower than $P_0$. In some embodiments, an instability in the PI controller may be a runaway P value, such as a P that is continuously increasing or continuously decreasing. An instability in the PI controller may lead to reduced efficiency in the drilling system, damage to one or more components of the drilling system, reduced ROP, and combinations thereof.

In some embodiments, to reduce instabilities, Equation 2 may be modified as a mixed PID controller, which includes state data regarding the WOB. In some embodiments, a mixed PID controller includes more than one state data as input. For example, a mixed PID controller may use both drilling fluid pressure and WOB in the terms. For example, the integral term may utilize drilling fluid pressure, and the proportional term may utilize WOB. Thus, Equation 2 may be modified to Equation 3-1, as shown below:

$$v=-a[1/\tau\int(P-P_0)+\alpha(W-W_0)] \quad \text{EQ. 3-1}$$

Or, to include the differential term, Equation 3-1 may be modified to Equation 3-2, shown below.

$$v=-a\left[\frac{1}{\tau}\int(P-P_0)+\alpha(W-W_0)+\delta\frac{d(W-W_0)}{dt}\right] \quad \text{EQ. 3-2}$$

As discussed above, the drilling fluid pressure lags the WOB, but the effect of WOB is effectively immediate (or at least is available significantly faster than drilling fluid pressure). By using Win the proportional term, the mixed PID controller may be more responsive to changes in v. Because the proportional term is more responsive to changes in v, the lag in drilling fluid pressure has less of a de-stabilizing effect on the mixed PID controller. In other words, because measuring W is more responsive to changes in v than P, the mixed PID controller may take into account the changes to v more quickly. However, because the integral term in Equations 3-1 and 3-2 still relies on P as measured over time, the PID controller may converge toward $P=P_0$. In some cases, the PID controller may therefore iteratively change the surface WOB to minimize the integral term.

In the embodiments shown in Equations 3-1 and 3-2, the proportional and differential terms include a weight offset $W_0$. The value of $W_0$ may not affect the long-term behavior of the PID controller. However, $W_0$ may have an effect on the short-term behavior of the PID controller. For example, at initiation of the PID controller, enough time may not have elapsed for the integral term to have counterbalanced the offset to v caused by $W_0$. After the PID controller has run for a period of time, the integral term may balance the effect on v caused by $W_0$. In some examples, when a is changed (such as to correct for imbalances in the system, as discussed herein), $W_0$ may have an effect on the PID controller until sufficient time has elapsed for the integral term to balance the effect on v.

To prevent short-term transients (e.g., changes in v) caused by $W_0$, the value of $W_0$ when the system is initiated may be close (e.g., within a convergence) to the value expected of the WOB when the operating drilling fluid pressure converges on the target drilling fluid pressure (e.g., when P equals $P_0$). If the coefficient $\alpha$ is changed, then the difference in the proportional term before and after the change to $\alpha$ may be subtracted from the integral term so that the instantaneous effect of changing $\alpha$ is not a change in v.

In some embodiments, the derivative term may not include a weight offset $W_0$. Thus, Equation 3-2 may be modified to Equation 3-3 as shown below $$v=-a\left[\frac{1}{\tau}\int(P-P_0)+\alpha(W-W_0)+\delta\frac{dW}{dt}\right] \quad \text{EQ. 3-3}$$

Thus, the PID controller implementing Equation 3-3 may include a derivative term based on the change in operating WOB with respect to time, multiplied by the derivative parameter $\delta$.

To determine the differential term, a differential of the WOB with respect to time is taken. For example, a series of WOB values may be analyzed, and a differential (e.g., the change in the measured WOB with respect to time) determined. This determined change in WOB with respect to time is the differential term. In some embodiments, if a direct measurement of the change in WOB is available, a sensor providing the change in WOB may be used to determine the change in WOB. The differential term is then multiplied by $\delta$, the differential parameter. The differential term, multiplied by the differential parameter, may then be added to the proportional-integral sum (e.g., the sum of the integral term and the proportional term) before multiplying the proportional-integral sum by a, which is the controller parameter.

In some embodiments, the PID controller implement Equation 3-1 or Equation 3-2 in an iterative process. For example, a first drilling fluid pressure may be measured and compared to the target drilling fluid pressure. In some embodiments, the target drilling fluid pressure may be the operating drilling fluid pressure of a downhole tool, such as a downhole motor. A first pressure difference between the first drilling fluid pressure and the target drilling fluid pressure may be determined. The first pressure difference is integrated since control is initiated to determine a first integrated pressure. A first WOB may be measured and compared to the target WOB to determine a weight difference. The target WOB may be added to the first integrated pressure to determine a first proportional-integral (PI) sum. The first PI sum may be multiplied by a controller parameter to determine a first surface ROP. In some embodiments, the target WOB may be determined by the target drilling fluid pressure. The WOB is related to the drilling fluid pressure. A higher WOB may result in a higher drilling fluid pressure, and a lower WOB may result in a lower drilling fluid pressure. Thus, the target WOB may be determined based on the target drilling fluid pressure. In some embodiments, the target WOB may be determined based on the bit. For example, the target WOB may be based on how much WOB the bit can support before damaging the bit and/or the cutting elements on the bit.

The PID controller may then change the drill pipe lowering rate from an initial drill pipe lowering rate to a first drill pipe lowering rate. By changing the drill pipe lowering rate, the WOB and the drilling fluid pressure may be changed. The PID controller may be configured to change the drill pipe lowering rate such that the drilling fluid pressure converges on the target drilling fluid pressure. This may help the downhole tool, such as the downhole motor, to operate at the optimal pressure differential, which may improve drilling efficiency and decrease wear on the downhole components In some embodiments, the first drill pipe lowering rate may be the same as the calculated first surface rate of penetration. The PID controller may then iteratively repeat the process. In other words, a second drilling fluid pressure may be measured and a second pressure difference determined. The second pressure difference may be integrated over the same length of time as the first pressure difference for a second integrated pressure. A second WOB may be measured and a second weight difference determined. The second weight difference and the second integrated pressure may be added together to determine a second PI sum. The second PI sum may be multiplied by the controller parameter to determine a second surface rate of penetration. The first drill pipe lowering rate may then be changed to a second drill pipe lowering rate based on the second surface rate of penetration (and therefore the second integrated pressure and/or the second weight difference). This process may then be repeated indefinitely until the operating drilling fluid pressure converges on the target drilling fluid pressure.

In some embodiments, the drill pipe lowering rate may be changed each iteration. In some embodiments, the drill pipe lowering rate may be changed to minimize the pressure difference and the integrated pressure. The percentage of P relative to $P_0$ (e.g., $P/P_0$) is the convergence. In some embodiments, the drill pipe lowering rate may be bring the convergence close to 100%. The operator may set the target drilling fluid pressure to be an operating pressure for a downhole tool. For example, a downhole motor, such as a mud motor or a turbine, may operate at an optimal drilling fluid pressure. The optimal drilling fluid pressure may be the same as, or related to, the pressure measured at the standpipe (which is the pressure used in the PID calculations). By setting the target drilling fluid pressure to (or based on) the optimal drilling fluid pressure, when the drilling system is operating at close to 100% convergence, the drilling system may be optimally efficient.

In some embodiments, the PID controller may include two proportional terms to help correct for instability. For example, the PID controller may include a first proportional term based on drilling fluid pressure, and a second proportional term based on WOB. This may cause the PID controller equation to resemble Equation 4:

$$v=-a[1/\tau\int(P-P_0)+(P-P_0)+\beta(W-W_0)] \quad \text{EQ. 4}$$

where β is a weight controller parameter. The weight controller parameter may be set by the operator. For example, the weight controller parameter may be initially set to zero. In this manner, Equation 4 may cause the PID controller to operate as a more conventional PID controller that does not include a weight proportional parameter.

In some embodiments, the operator (including a monitoring system such as an automated monitoring program) may identify instability in the drilling system (e.g., fluctuating convergence, runaway pressure difference, etc.). When instability is identified, the operator may change the value of β to correct for the instability. For example, β may be increased until the WOB proportional term helps to stabilize the system. In some embodiments, when stability is identified (e.g., a convergence of 100% or within a convergence zone of 95% to 105% over a period of time), β is be reduced. In some embodiments, as discussed herein, when a change is made to β, then a corresponding change may be made to the integral term. For example, if a change is made to β that would increase v, then a corresponding decrease to the proportional term may be made. This may reduce an instantaneous change in v, thereby reducing large fluctuations in surface ROP.

In some embodiments, the derivative term may be added to Equation 4, turning Equation 4 into Equation 5:

$$v=-a\left[\frac{1}{\tau}\int(P-P_0)+(P-P_0)+\beta(W-W_0)+\delta\frac{dW}{dt}\right] \quad \text{EQ. 5}$$

The derivative term may further contribute to the stability and/or the responsiveness of the PID controller.

In some embodiments, PID controllers of the present disclosure may be responsive to changes in drilling conditions. For example, if a drill bit encounters a change in formation while drilling, the downhole ROP and drilling fluid pressure may change as a result of the change in drilling conditions. The change in downhole ROP and drilling fluid pressure may be measured at the surface, and the PID controller may automatically change the drill pipe lowering rate to compensate. Changing the drill pipe lowering rate to maintain a convergence of the drilling fluid pressure may help the downhole drilling system to operate at a desired drilling fluid pressure and WOB. The desired drilling fluid pressure and WOB may be selected by the operator to optimize ROP and reduce wear and tear on the downhole tools. Thus, utilizing a PID controller of the present disclosure may increase the responsiveness of the drilling system, thereby improving the rate of penetration, decreasing wear and tear on components, and decreasing costs.

Figure 2:
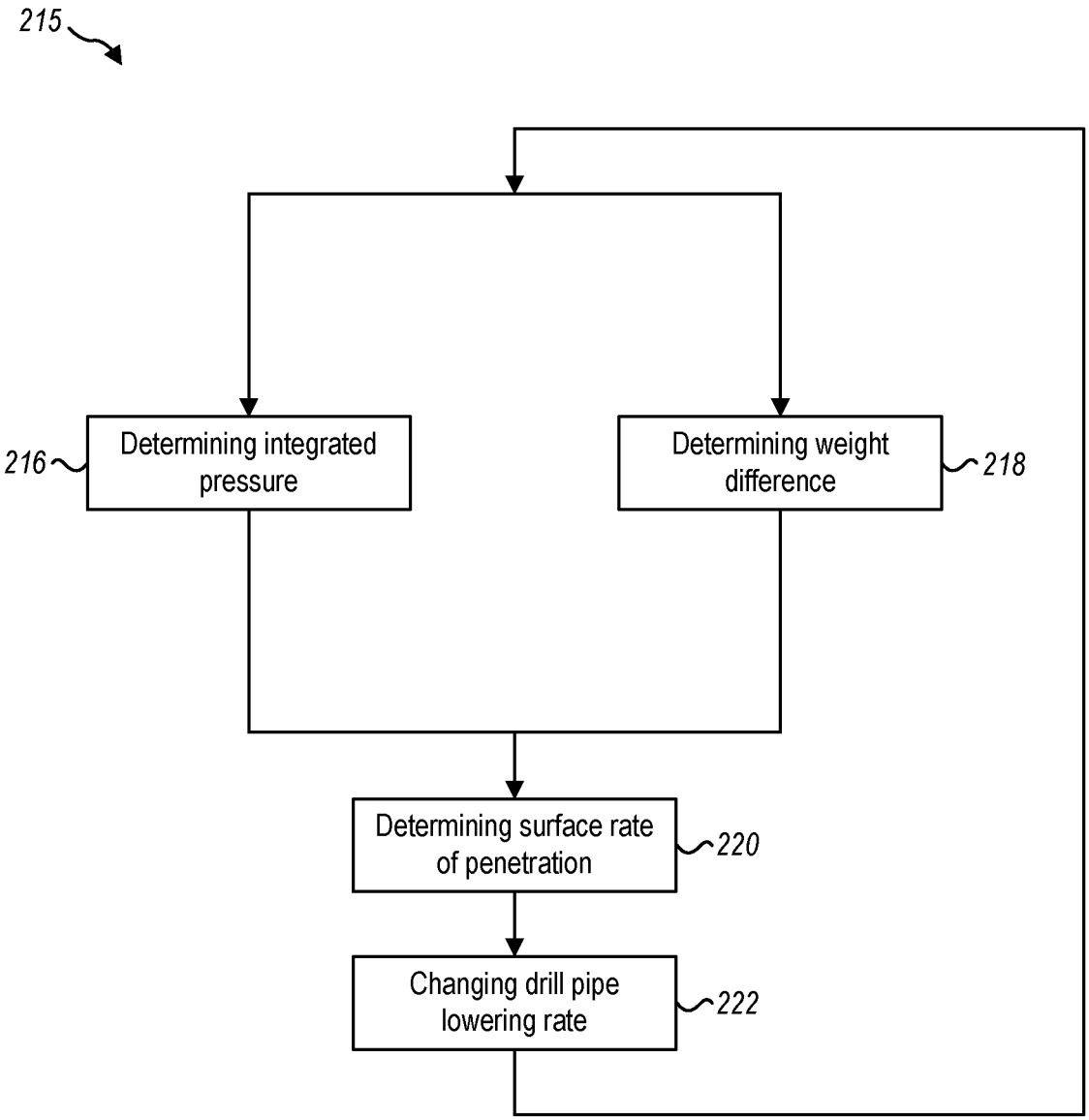
FIG. 2 is a flowchart of a method for drilling, according to at least one embodiment of the present disclosure.

FIG. 2 is a flowchart illustrating an example method 215 for using a PID controller in a drilling process, according to at least one embodiment of the present disclosure. In some embodiments, the PID controller described with reference to FIG. 2 may be directed, at least in part by, Equation 3-1, Equation 3-2, and/or Equation 3-3. Thus, the PID controller used in the method 215 may be a mixed PID controller, or may use more than one state data for control (e.g., drilling fluid pressure and WOB). The method 215 includes determining an integrated pressure at 216. The integrated pressure may be determined by integrating a pressure difference between an operating drilling fluid pressure and a target drilling fluid pressure. For example, the drilling fluid pressure may be measured at a surface location, such as a standpipe. In some examples, the drilling fluid pressure may be measured at a downhole location, such as at a downhole motor. The drilling fluid pressure compared to the target drilling fluid may be directly measured or observed, or may be obtained/received in another manner (e.g., received from a system inferring the measurement from other parameters, received from a third party, input manually, etc.).

In some embodiments, the integrated pressure may be the integral term of Equation 3-1, Equation 3-2, or Equation 3-3. Accordingly, and similar to the discussion above, the integrated pressure may be used as feedback based on historical drilling fluid pressure. Thus, the integrated pressure may be as simple as a summation of each pressure difference since control is initiated. For example, if the pressure difference is positive, then the integral term will grow and have a bigger impact on the surface rate of penetration. Similarly, if the pressure difference is negative, then the integrated pressure will shrink and have a smaller impact on the surface rate of penetration. The ratio of the constant of proportionality of the integral term to the constant of proportionality of the pressure difference term may affect the impact of the integrated pressure on the surface rate of penetration. A small ratio may de-emphasize short-term fluctuations in the pressure difference, while a larger ratio may be more responsive to changes in the pressure difference.

In the method 215, a weight difference is determined at 218. The weight difference may be the difference between a measured WOB and a target WOB. In some embodiments, the WOB may be a surface WOB. In some embodiments, the WOB may be a downhole WOB. A surface ROP may be determined at 220, and may be based on the integrated pressure and the pressure difference. In some embodiments, the surface ROP may be related to the rate that a traveling block on the surface is lowered. Accordingly, based on the surface ROP, the PID controller may change a drill pipe lowering rate (e.g., the rate at which the traveling block is lowered) at 222.

In some embodiments, the weight difference may be used as the proportional term of Equation 3-1, Equation 3-2, and/or Equation 3-3. Accordingly, the weight difference may be used as proportional feedback based on a change in the WOB. Thus, if the current WOB is different than target WOB, then the surface rate of penetration would be changed in proportion to the weight difference. After the drill pipe lowering rate is changed, the method 215 may be repeated. Thus, the method 215 may form a loop in which the drill pipe lowering rate is changed based on the integrated pressure and the weight difference. Each iteration of the loop of the method 215 may cause a change in the drill pipe lowering rate. As discussed above, the drill pipe lowering rate may be changed until the operating drilling fluid pressure converges on the target drilling fluid pressure. This may help to operate the downhole drilling system at an optimal pressure.

Figure 3:
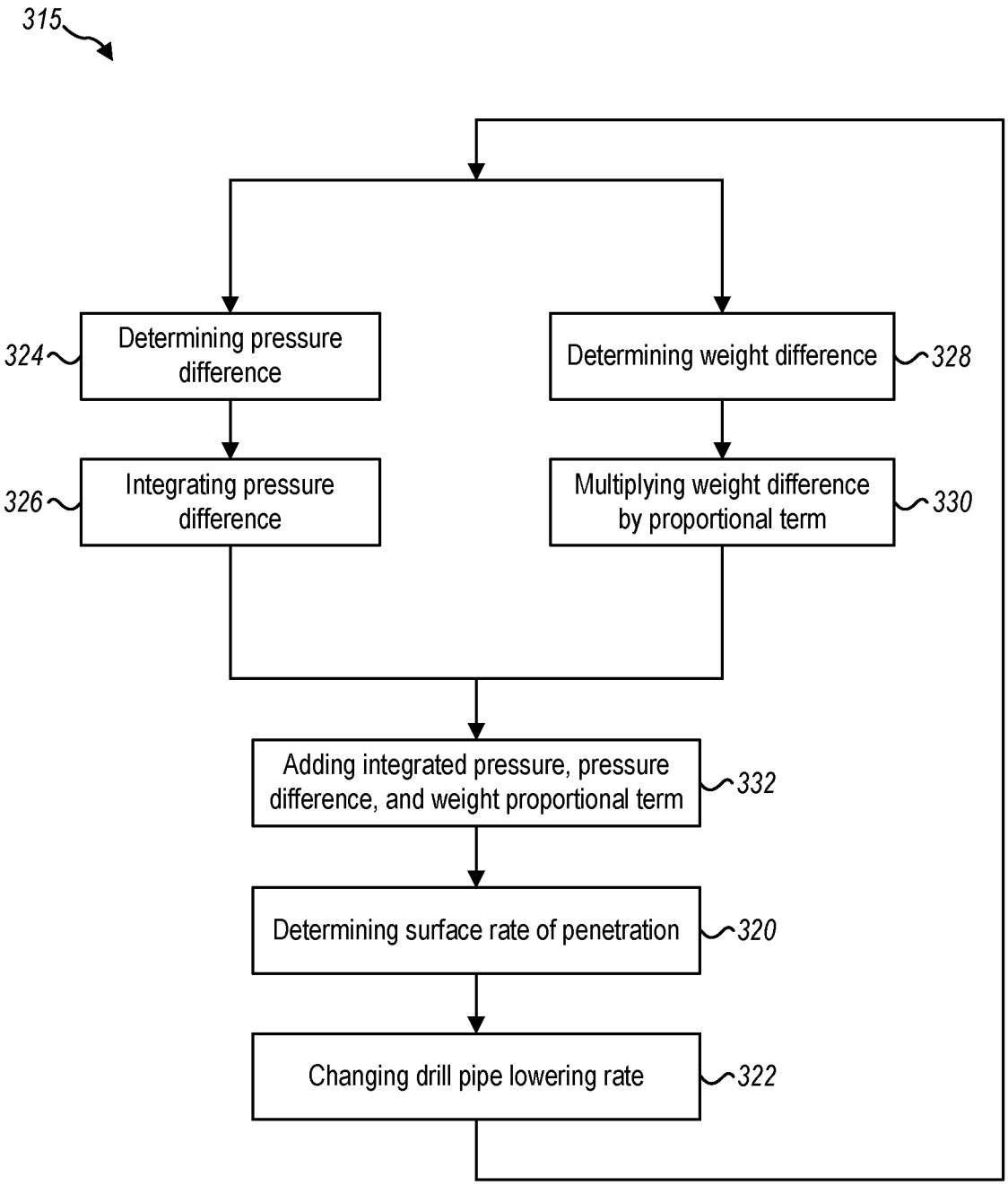
FIG. 3 is another flowchart of a drilling method, according to at least one embodiment of the present disclosure.

FIG. 3 is a flowchart illustrating a method 315 for using a PID controller in a drilling process, according to at least one embodiment of the present disclosure. In some embodiments, the PID controller described with reference to FIG. 3 may be directed, at least in part by, Equation 4. Thus, the PID controller may be a mixed controller, or may analyze more than one state data parameter, to control drilling. For example, the method 315 may analyze both drilling fluid pressure and WOB to control drilling operations. The method 315 includes determining a pressure difference at 324, which may include a difference between an obtained drilling fluid pressure (e.g., from measurement, observation, or transmission) and a target drilling fluid pressure. The pressure difference may be the $P-P_0$ from the integral term and the proportional term of Equation 4. The method 315 may further include integrating the pressure difference over a time at 326 to obtain an integrated pressure (e.g., the integral term of Equation 3-1 and Equation 3-2.

Within the method 315, a weight difference may be determined at 328. The weight difference may be the $W-W_0$ term of Equation 3-1 and Equation 3-2. The weight difference may be the difference between an obtained (e.g., measured, observed, or transmitted) WOB and a target WOB. The weight difference may be multiplied by a proportional term (e.g., $\beta$) at 330, to obtain a weight proportional term. In some embodiments, the value of the target WOB may not affect the long-term behavior of the PID controller. However, the target WOB may have an effect on the short-term behavior of the PID controller. For example, at initiation of the PID controller, enough time may not have elapsed for the integral term to have counterbalanced the offset to the surface ROP caused by the target WOB. After the PID controller has run for a period of time, the integral term may balance the effect on v caused by the target WOB. In some examples, when the weight proportional factor is changed (such as to correct for imbalances in the system, as discussed herein), the target WOB may have an effect on the PID controller until sufficient time has elapsed for the integral term to balance the effect on v.

To prevent short-term transients (e.g., changes in the surface ROP) caused by the target WOB, the value of the target WOB when the system is initiated may be close (e.g., within a convergence) to the value expected of the WOB when the operating drilling fluid pressure converges on the target drilling fluid pressure (e.g., when the operating drilling fluid pressure equals the target drilling fluid pressure). If the weight proportional factor is changed, then the difference in the proportional term before and after the change to the weight proportional factor may be subtracted from the integral term so that the instantaneous effect of changing the weight proportional factor is not a change in the surface ROP.

The method 315 may further include adding the integrated pressure, the pressure difference, and the weight proportional term for a proportional-integral (PI) sum at 332. Based at least in part on the PI sum, a surface ROP may be determined at 320, which may be used to determine and set the drill pipe lowering rate at 322.

The mixed controller of FIG. 3 may include proportional terms for both the drilling fluid pressure and the WOB, as described above in reference to Equation 4. When the drill pipe lowering rate is changed, the method 315 may be repeated. Thus, the method 315 may be a loop, and repeated indefinitely. Because the method 315 utilizes a proportional term of both drilling fluid pressure and WOB, the method 315 may be immediately responsive to changes in drilling fluid pressure and WOB, which may allow for a greater amount of control to the drill pipe lowering rate. This may help to keep the downhole drilling system operating at the target drilling fluid pressure, which may help to reduce wear on the system, improve ROP, and reduce costs.

Figure 4:
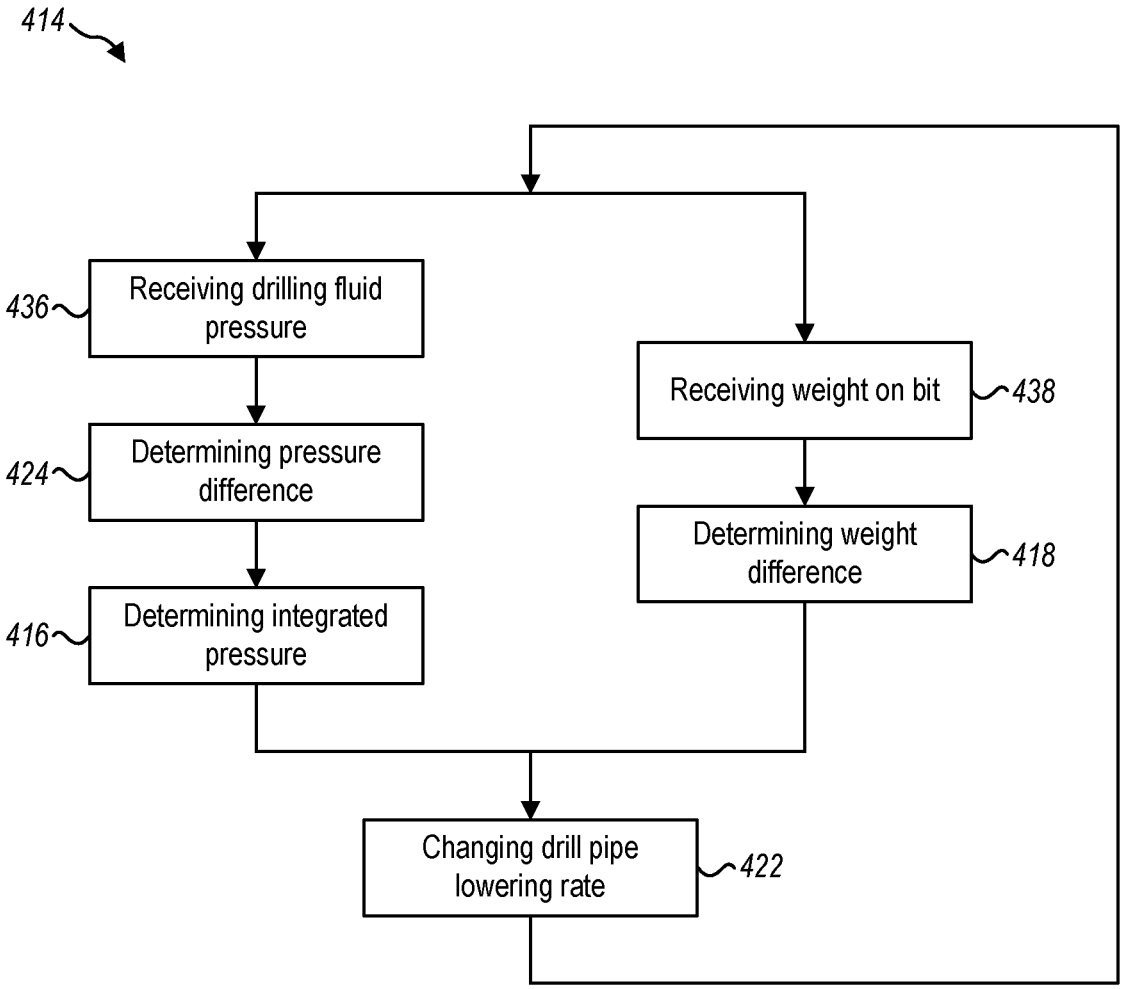
FIG. 4 is another flowchart depicting a method of drilling, according to at least one embodiment of the present disclosure.

FIG. 4 is a flowchart of another method 414 for using a PID controller in a drilling process, according to at least one embodiment of the present disclosure. In some embodiments, the PID controller described with reference to FIG. 4 may be directed, at least in part by, Equation 4. Thus, the PID controller may be a mixed controller, or may analyze more than one state data parameter, to control drilling. For example, the method 414 may analyze both drilling fluid pressure and WOB to control drilling operations. The method 414 includes determining a pressure difference at 424, which may be determined in a manner as discussed herein (e.g., acts 224, 324 of FIGS. 2 and 3). The method 414 may further include integrating the pressure difference (e.g., $P-P_0$ of Equation 4) over a time period at 426 to obtain an integrated pressure (e.g., the integral term of Equation 4), and a weight difference (e.g., $W-W_0$ of Equation 4) may be determined at 428. The weight difference may be the difference between a measured and/or obtained WOB and a target WOB. The weight difference may be multiplied by a proportional term (e.g., $\beta$ of Equation 4) at 430 to obtain a weight proportional term.

FIG. 4 is a flowchart of a method 414 for using a PID controller in a drilling process, according to at least one embodiment of the present disclosure. The method 414 includes receiving or otherwise obtaining a drilling fluid pressure at 436. In some embodiments, receiving the drilling fluid pressure may include measuring the drilling fluid pressure at the standpipe. In some embodiments, receiving the drilling fluid pressure may include receiving the drilling fluid pressure from a source. For example, the drilling fluid pressure may be input into the PID controller by the operator, measured by a sensor, or the like. In some examples, the drilling fluid pressure may be communicated to the PID controller from a remote location, such as a remote computing system or sensor. In some examples, the drilling fluid pressure may be measured at a downhole location (e.g., the bit, the mud motor) and communicated to the surface.

In the method 414, a pressure difference is determined at 424. In some embodiments, the pressure difference may be the difference between the received drilling fluid pressure and a target drilling fluid pressure. An integrated pressure may be determined at 416. The integrated pressure may be determined based on the pressure difference determined at 424. In some embodiments, the integrated pressure may be the integral of the pressure difference.

The method 414 may further include receiving or otherwise obtaining a WOB at 438. In some embodiments, receiving the WOB occur simultaneous with acts used to determine integrated pressure at 416, or may occur before or after such acts. Receiving the WOB at 438 may include measuring the WOB (e.g., at the bit or BHA). In some embodiments, receiving the WOB may include receiving the WOB from a source. For example, the WOB may be input into the PID controller by the operator. In some examples, the WOB may be communicated to the PID controller from a remote location such as a remote computing system or sensor. Using the received WOB, a weight difference between the received WOB and a target WOB may be determined at 418. In some embodiments, a PID controller may implement at least one of Equation 3-1, 3-2, 4, or 5 using the received drilling fluid pressure and the received WOB. The PID controller may then determine a surface rate of penetration according to the equations discussed above. A drill pipe lowering rate may be changed according to the determined surface rate of penetration at 422. The drill pipe lowering rate may be changed based on at least one of the weight difference or the integrated pressure.

Embodiments of PID controllers and methods of using PID controllers have been primarily described with reference to wellbore drilling operations; however, PID controllers and associated methods may be used in applications other than the drilling of a wellbore. In other embodiments, PID controllers according to the present disclosure may be used outside a wellbore or other downhole environment used for the exploration or production of natural resources. For instance, PID controllers of the present disclosure may be used in a borehole used for placement of utility lines. Accordingly, the terms "wellbore," "borehole" and the like should not be interpreted to limit tools, systems, assemblies, or methods of the present disclosure to any particular industry, field, or environment.

One or more specific embodiments of the present disclosure are described herein. These described embodiments are examples of the presently disclosed techniques. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that is within standard manufacturing or process tolerances, or which still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A method of drilling, comprising:

determining a weight difference between an operating weight on bit and a target weight on bit;

determining a pressure difference between an operating drilling fluid pressure and a target drilling fluid pressure;

determining an integrated pressure over time based on the pressure difference;

determining a surface rate of penetration based on the integrated pressure and the weight difference; and based on the surface rate of penetration, changing a drill pipe lowering rate.

2. The method of claim 1, wherein changing the drill pipe lowering rate includes changing the operating weight on bit and the operating drilling fluid pressure.

3. The method of claim 2, wherein changing the drill pipe lowering rate includes increasing the drill pipe lowering rate and thereby increasing the operating weight on bit and the operating drilling fluid pressure.

4. The method of claim 2, wherein changing the surface rate of penetration includes decreasing the drill pipe lowering rate and thereby decreasing the operating weight on bit and the operating drilling fluid pressure.

5. The method of claim 1, the operating drilling fluid pressure being measured at a surface location, a measured change in the operating drilling fluid pressure lagging a measured change in the operating weight on bit at the surface location.

6. The method of claim 1, further comprising:

determining a weight on bit differential based on a change in the operating weight on bit over time and wherein determining the surface rate of penetration is based at least in part on the weight on bit differential.

7. The method of claim 1, the target drilling fluid pressure being an operating drilling fluid pressure for a downhole tool.

8. A method for drilling, comprising:

determining a pressure difference between an operating drilling fluid pressure and a target drilling fluid pressure;

integrating the pressure difference over time and obtaining an integrated pressure;

determining a weight difference between an operating weight on bit and a target weight on bit;

multiplying the weight difference by a proportional term for a weight proportional term;

adding the integrated pressure, the pressure difference, and the weight proportional term for a proportional-integral sum;

based on the proportional-integral sum, determining a surface rate of penetration; and changing a drill pipe lowering rate based on the surface rate of penetration.

9. The method of claim 8, wherein changing the drill pipe lowering rate includes determining that the changed drill pipe lowering rate will reduce the pressure difference.

10. The method of claim 8, further comprising:

correcting for instability in the pressure difference by changing the proportional term.

11. The method of claim 8, further comprising iteratively changing the drill pipe lowering rate until the operating drilling fluid pressure and the target drilling fluid pressure converge.

12. A method for drilling, comprising:

obtaining an operating drilling fluid pressure;

determining a pressure difference based on the operating drilling fluid pressure and a target drilling fluid pressure;

determining an integrated pressure based on the pressure difference;

obtaining an operating weight on bit;

determining a weight difference based on the operating weight on bit and a target weight on bit; and changing a drill pipe lowering rate based on at least one of the weight difference or the integrated pressure, wherein changing the drill pipe lowering rate includes reducing the integrated pressure by iteratively changing the drill pipe lowering rate.

13. The method of claim 12, wherein changing the drill pipe lowering rate includes increasing the drill pipe lowering rate when the operating drilling fluid pressure is less than the target drilling fluid pressure.

14. The method of claim 12, wherein obtaining the operating drilling fluid pressure includes measuring the operating drilling fluid pressure.

15. The method of claim 12, wherein obtaining the operating weight on bit includes measuring the operating weight on bit.

16. The method of claim 12, wherein changing the drill pipe lowering rate includes decreasing the drill pipe lowering rate when the operating drilling fluid pressure is greater than the target drilling fluid pressure.

17. The method of claim 12, wherein obtaining the operating drilling fluid pressure and obtaining the operating weight on bit occurs at a surface location.

18. The method of claim 12, wherein iteratively changing the drill pipe lowering rate includes iteratively changing the drill pipe lowering rate until the operating drilling fluid pressure and the target drilling fluid pressure converge.

19. The method of claim 12, the drill pipe lowering rate being a first drill pipe lowering rate, the operating weight on bit being a first operating weight on bit, the operating drilling fluid pressure being a first operating drilling fluid pressure, and the pressure difference being a first pressure difference, and wherein iteratively changing the drill pipe lowering rate includes:

obtaining a second operating weight on bit;

obtaining a second operating drilling fluid pressure;

determining a second pressure difference based on the second operating drilling fluid pressure and the target drilling fluid pressure; and determining a second weight difference based on the second operating weight on bit and the target weight on bit; and the method further comprising:

changing the first drill pipe lowering rate to a second drill pipe lowering rate based on at least one of the second pressure difference or the second weight difference.

20. The method of claim 12, wherein changing the drill pipe lowering rate is further based on at least a surface rate of penetration determined based on the weight difference.

* * * * *